US006176596B1

(12) United States Patent
Shukla et al.

(10) Patent No.: US 6,176,596 B1
(45) Date of Patent: Jan. 23, 2001

(54) COMBINATION FLASHLIGHT AN ELECTRICAL POWER SOURCE ASSEMBLY AND EMITTER AND REFLECTOR THEREFOR

(75) Inventors: Kailash C. Shukla, Boxborough; Edward F. Doyle, Dedham; Frederick E. Becker, Reading; Ann S. Buck, Stow, all of MA (US); Andrew E. Masters, Berlin, MD (US); Maurice Nunes, Arlington, MA (US)

(73) Assignee: Thermo Power Corporation, Waltham, MA (US)

( * ) Notice: Under 35 U.S.C. 154(b), the term of this patent shall be extended for 0 days.

(21) Appl. No.: 09/353,934

(22) Filed: Jul. 15, 1999

(51) Int. Cl.[7] ..... F21V 33/00

(52) U.S. Cl. ..... 362/253; 362/229; 362/159; 362/192

(58) Field of Search ..... 362/229, 179, 362/157, 252, 253; 431/100, 328, 329; 136/252, 257; 252/492

(56) References Cited

U.S. PATENT DOCUMENTS

| | | | |
|---|---|---|---|
| 4,584,426 | 4/1986 | Nelson | 136/253 |
| 4,764,104 | 8/1988 | Nelson | 431/100 |
| 4,826,426 | 5/1989 | Nelson | 431/100 |
| 4,975,044 | 12/1990 | Diederich | 431/110 |
| 4,976,606 | 12/1990 | Nelson | 431/79 |
| 5,137,583 | 8/1992 | Parent et al. | 136/253 |
| 5,240,407 | 8/1993 | Diederich et al. | 431/110 |
| 5,312,521 | 5/1994 | Fraas et al. | 136/253 |
| 5,383,976 | 1/1995 | Fraas et al. | 136/253 |
| 5,522,722 | 6/1996 | Diederich | 431/89 |
| 5,601,357 | 2/1997 | Rangarajan | 362/179 |
| 5,947,590 * | 9/1999 | Meuse | 362/264 |
| 6,092,912 * | 7/2000 | Nelson | 362/253 |

* cited by examiner

*Primary Examiner*—Sandra O'Shea
*Assistant Examiner*—Hargobind S. Sawhney
(74) *Attorney, Agent, or Firm*—Pandiscio & Pandiscio

(57) ABSTRACT

A combination flashlight and electrical power source assembly includes an emitter and fuel system module, a fuel cartridge module fixed to the emitter and fuel system module, a photovoltaic conversion module attachable to a selected one of the emitter and fuel system module and the fuel cartridge module, and a flashlight lens module attachable to the other of the emitter and fuel system module and the fuel cartridge module. When the photovoltaic conversion module is attached to the emitter and fuel system module and the flashlight lens module is attached to the fuel cartridge module, the photovoltaic conversion module is active, the flashlight lens module functions as an end cap, and the assembly functions as an electrical power source. When the flashlight lens module is attached to the emitter and fuel system module and the photovoltaic module is attached to the fuel cartridge module, the flashlight lens module is active, the photovoltaic conversion module functions as an end cap, and the assembly functions as a flashlight.

32 Claims, 5 Drawing Sheets

COMBINATION FLASHLIGHT AN ELECTRICAL POWER SOURCE ASSEMBLY AND EMITTER AND REFLECTOR THEREFOR

BACKGROUND OF THE INVENTION

1. Field of the Invention

The invention relates to gas-powered flashlights and to gas-powered thermophotovoltaic power sources, and is directed more particularly to a single assembly of components which is convertible from one to the other.

2. Description of the Prior Art

Gas powered flashlights are known. For example, in U.S. Pat. No. 5,601,357, issued Feb. 11, 1997 to Anand Rangarajan, and incorporated herein by reference, there is disclosed a flashlight having a mantle structure composed of multifiliment metal oxide strands and mounted on a fuel supply conduit adjacent an outlet port thereof. An igniter is disposed so as to ignite the fuel to cause the mantle structure to become incandescent and emit optical radiation. The flashlight is provided with a chamber for receiving and retaining a fuel canister for supplying fuel to the fuel supply conduit and the outlet port thereof. The fuel typically is liquid propane.

In U.S. Pat. No. 5,522,722, issued Jun. 4, 1996 to Walter J. Diederich, and incorporated herein by reference, there is disclosed a fuel control system for controlling the fuel vapor flow rate from the fuel canister to the fuel supply outlet port.

It is further known to provide gas powered DC electric power generators comprising thermophotovoltaic devices including a photocell and an emitter of rare earth metal oxide material disposed in optically coupled relation to the photocell. Such devices can be used for off-grid electric power for powering equipment, non-wired homes, emergency devices, communication devices, recharging batteries, and the like. See U.S. Pat. No. 4,584,426, issued Apr. 22, 1986, to Robert E. Nelson, and U.S. Pat. No. 5,312,521, issued May 17, 1994, to Arthur P. Fraas et al.

In camping and field environments, including military environments, there is a need for a DC power generator which is readily available for use in recharging batteries and powering communications and other such equipment. However, it is not desirable to add to an already formidable list of devices and equipment which must be carried into the field. That is, there is a need for a DC power generator which serves a dual function, such that another discrete piece of equipment is not required. Inasmuch as flashlights already are customarily carried into field operations, a combination flashlight and DC generator, of about the same size and weight as a traditional flashlight, appears to provide that which is needed.

SUMMARY OF THE INVENTION

An object of the invention is, therefore, to provide a combination flashlight and electrical power source assembly.

A further object is to provide a combination flashlight and electrical power source assembly wherein the assembly may readily, easily and speedily be converted from one to the other, without any specialized skills, tools, or extra parts required.

A still further object is to provide an emitter for use in the combination flashlight and electrical power source assembly above described.

A still further object of the invention is to provide a reflector for use in the combination flashlight and electrical power source.

With the above and other objects in view, as will hereinafter appear, a feature of the present invention is the provision of a combination flashlight and electrical power source assembly, the assembly comprising an emitter and fuel system module having first and second ends, a fuel cartridge module fixed to the emitter and fuel system module at the second end of the emitter and fuel system module, the fuel cartridge module having a free end, a photovoltaic conversion module attachable to a selected one of the emitter and fuel system module first end and the fuel cartridge module free end, and a flashlight lens module attachable to the other of the emitter and fuel system module first end and the fuel cartridge module free end. When the photovoltaic conversion module is attached to the emitter and fuel system module first end and the flashlight lens module is attached to the fuel cartridge module free end, the photovoltaic conversion module is an active module and the flashlight lens module is inactive and functions as an end cap. The assembly thus comprises the aforementioned electrical power source. When the flashlight lens module is attached to the emitter and fuel system module first end and the photovoltaic conversation module is attached to the fuel cartridge module free end, the flashlight lens module is an active module and the photovoltaic conversion module is inactive and functions as an end cap. The assembly thus comprises the aforementioned flashlight.

In accordance with a further feature of the invention, there is provided an emitter for illumination by combustion of a fuel therein and for radiating light. The emitter comprises an inner mantle having a net of ceramic fibers, the inner mantle having a bulbous portion and being adapted for attachment to a discharge end of a fuel supply conduit, and an outer mantle having a net of ceramic fibers, the outer mantle having a bulbous portion disposed around and spaced from the bulbous portion of the inner mantle and having a further portion overlying the inner mantle along a portion of the inner mantle which is adapted for attachment to the fuel supply conduit. The inner mantle is adapted to illuminate and radiate light when subjected to combustion at a selected first rate, with the light radiated by the inner mantle passing through the outer mantle, the outer mantle being non-illuminated and non-light-radiating at the first combustion rate, and the inner and outer mantles are both adapted to illuminate and radiate light when subjected to combustion at a selected second rate of combustion substantially higher than the first rate of combustion.

In accordance with a further feature of the invention, there is provided an alternative emitter. The alternative emitter comprises a first mantle having a generally planar base member defining a multiplicity of portals therethrough and a central opening therethrough, and a multiplicity of mantle elements fixed to a first surface of the base member. A fuel conduit is mounted in the central opening and extends therethrough. A second mantle of generally bulbous configuration is mounted on a first end of the fuel conduit proximate the base member first surface. A flow diverter is disposed proximate a second surface of the base member, a second end of the fuel conduit extending through the flow diverter. The flow diverter is operable to prevent flow of fuel to the portals, such that fuel admitted to the emitter is flowable only through the fuel conduit to the second mantle, and operable to allow flow of fuel to the portals, such that fuel admitted to the emitter is flowable through the fuel conduit to the second mantle and is flowable through the portals to the first mantle elements.

In accordance with a still further feature of the invention, there is provided a reflector for focusing light emitted from a mantle through a lens. The reflector comprises a body portion defining a generally parabolic interior surface for reflecting and focusing the emitted light, a tubular portion extending from the body portion and defining an opening for receiving the mantle and a portion of a fuel conduit fixed to the mantle, and fins extending outwardly from the body portion for conducting heat from the body portion.

The above and other features of the invention, including various novel details of construction and combinations of parts, will now be more particularly described with reference to the accompanying drawings and pointed out in the claims. It will be understood that the particular devices embodying the invention are shown by way of illustration only and not as limitations of the invention. The principles and features of this invention may be employed in various and numerous embodiments without departing from the scope of the invention.

BRIEF DESCRIPTION OF THE DRAWINGS

Reference is made to the accompanying drawings in which is shown illustrative embodiments of the invention, from which its novel features and advantages will be apparent.

In the drawings.

DESCRIPTION OF THE PREFERRED EMBODIMENTS

Figure 1:
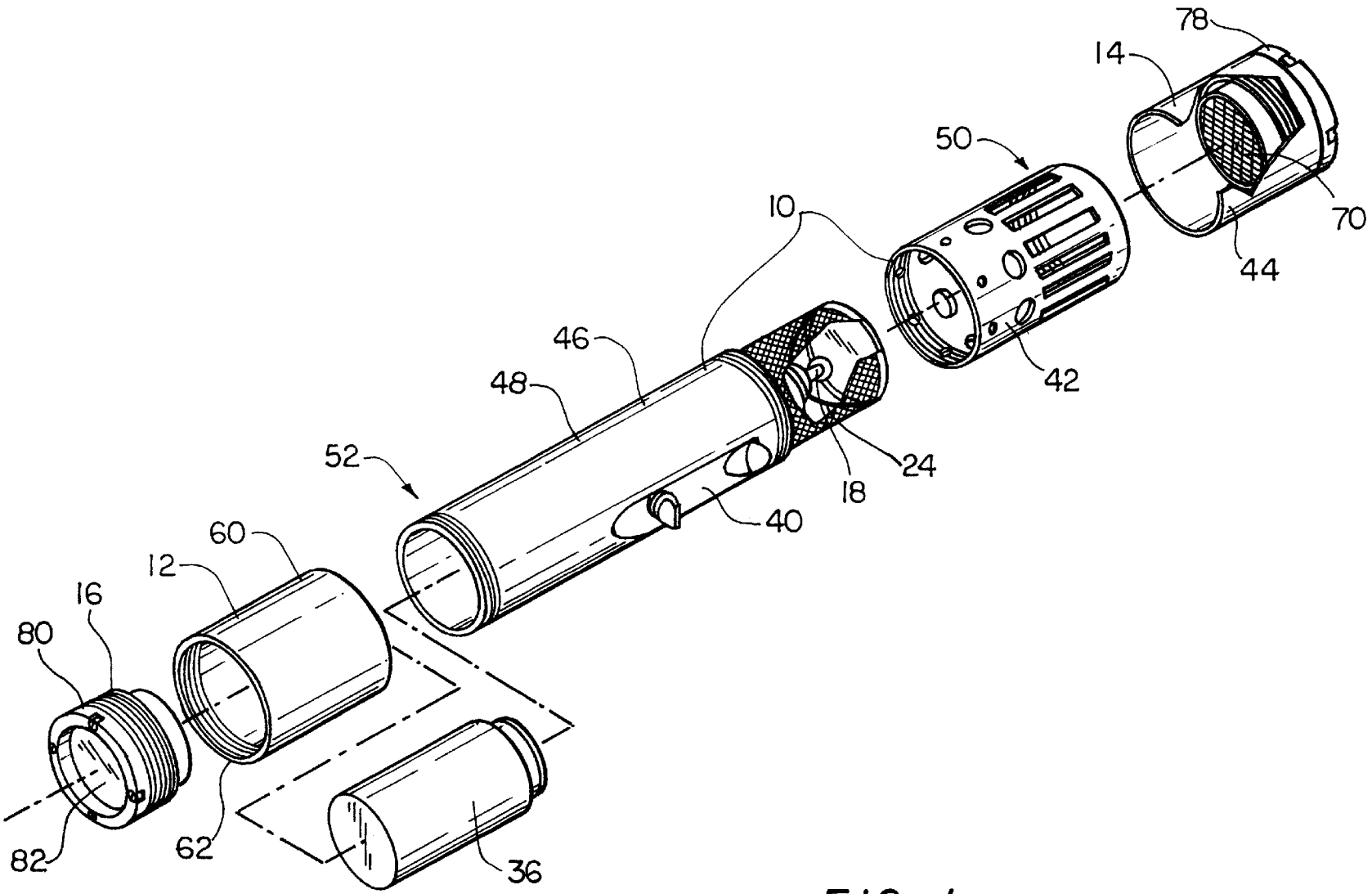
FIG. 1 is an exploded perspective view of one form of combination flashlight and electrical power source assembly illustrative of an embodiment of the invention.

Referring to FIG. 1, it will be seen that the illustrative assembly includes an emitter and fuel system module 10, a fuel cartridge module 12, a photovoltaic conversion module 14, and a flashlight lens module 16.

Figure 2:
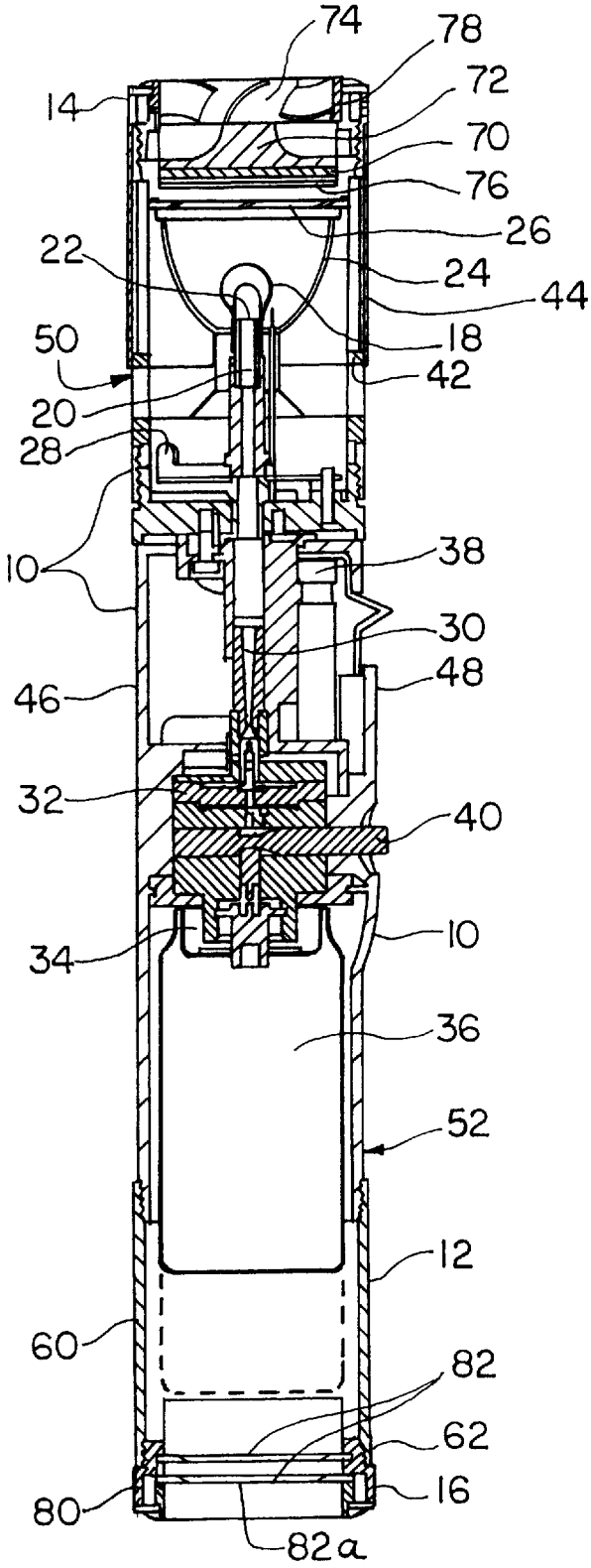
FIG. 2 is a sectional view of the components shown in FIG. 1 assembled to form an electrical power source.
Figure 3:
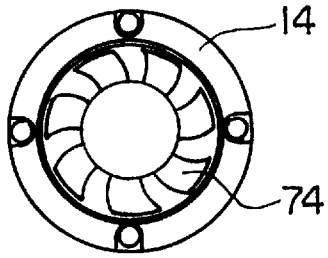
FIG. 3 is a distal end view of the assembly of FIG. 2.
Figure 4:
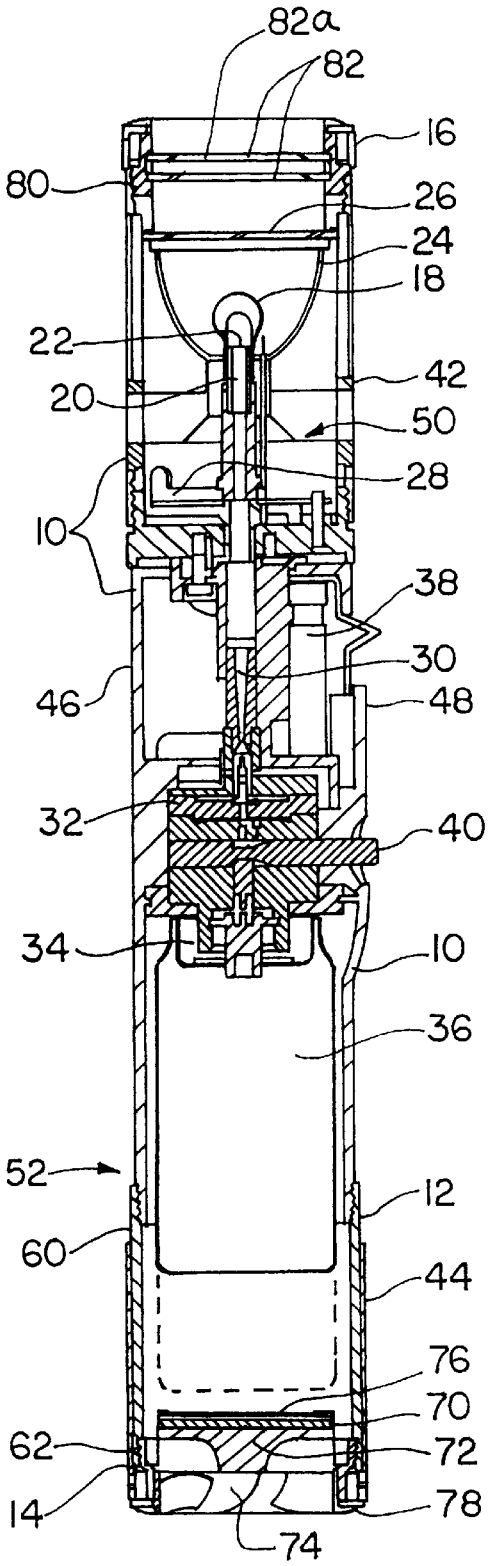
FIG. 4 is a sectional view of the components shown in FIG. 1 assembled to form a flashlight.
Figure 5:
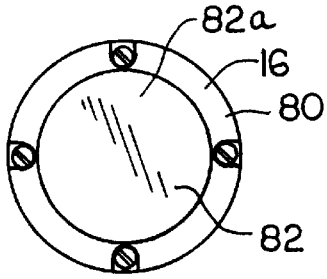
FIG. 5 is a distal end view of the assembly of FIG. 4.

As shown in FIGS. 2 and 4, the emitter and fuel system module 10 includes an emitter 18 comprising a self-supporting metal oxide fiber mantle supported on a fuel supply conduit 20 having a outlet port 22, generally as described in U.S. Pat. No. 4,975,044, issued Dec. 4, 1990, to Walter J. Diederich. The emitter 18 unit will be further described hereinbelow.

The emitter and fuel system module 10 further includes a reflector 24 which focuses radiant energy from the emitter 18 and delivers the radiant energy to either the photovoltaic conversion module 14, as shown in FIG. 2, or to the flashlight lens module 16, as shown in FIG. 4. The reflector 24 may be provided with fins (not shown) for heat dissipation. An emitter cover glass 26 is mounted over the emitter 18 and the reflector 24 and serves to protect the emitter 18 and to isolate combustion gasses from the photovoltaic conversion module 14 when the module 14 is fixed to the module 10. An emitter holder 28 provides a simple snap-in mechanism for holding the emitter 18 in place and for releasing and replacing the emitter.

The emitter and fuel system module 10 still further includes a venturi tube 30 through which gaseous fuel flows, inducing the flow of air thereinto, and which provides for mixing of the fuel and air prior to combustion in the emitter 18. A pressure regulator 32 maintains fuel pressure in the venturi tube 30 constant, to maintain a constant fuel flow rate over a wide range of ambient conditions. The pressure regulator 32 also provides a quick connect/disconnect fitting 34 for a fuel cartridge 36. A piezoelectric igniter 38 provides reliable ignition.

An on/off valve 40 serves to start and stop fuel flow through the venturi tube 30 and further serves as a mechanism for adjusting fuel pressure at the regulator 32, and thereby the fuel flow, for either the power mode of operation (FIG. 2) or the flashlight mode of operation (FIG. 4). An air control sleeve 42, in combination with a heat management baffle 44 on the photovoltaic conversion module 16, guides cooling air flow, and may easily be removed from the emitter and fuel system module 10 for access to the emitter 18 for replacement thereof.

Finally, the emitter and fuel system module 10 includes a main body housing 46 which contains the aforementioned emitter and fuel system components, and which provides a surface 48 for gripping and handling the assembly. The emitter and fuel system module 10 is provided with first and second ends 50, 52.

Still referring to FIGS. 2 and 4, it will be seen that the fuel cartridge module 12 includes a fuel cartridge cover 60 which is attachable to, and removable from, the emitter and fuel system module second end 52.

The fuel cartridge 36 can be snapped or screwed onto the pressure regulator fitting 34 and pulled or unscrewed therefrom for replacement, and is housed in part in the emitter and fuel system module 10 and in part in the fuel cartridge module 12 and, more specifically, the fuel cartridge cover 60. The fuel cartridge module 12 is removably fixed to the second end 52 of the emitter and fuel system module and is provided with a free end 62. The fuel cartridge 36 typically houses liquid propane or butane.

The photovoltaic conversion module 14 includes a thermophotovoltaic (TPV) array 70 of Gallium Antimonide (GaSb) cells (or Indium Gallium Arsenide (InGaAs) cells, or Silicon (Si) cells) connected in series for converting radiant energy from the emitter 18 to 12 volt DC power. A heat sink 72 dissipates heat from the TPV array 70, and a fan and motor 74 provide cooling air to the heat sink 72 and to the emitter and fuel system module 10 in the power mode (FIG. 2). A TPV cover glass 76 protects the TPV array 70. The aforementioned heat management baffle 44 which comprises a portion of the photovoltaic conversion module 14, directs cooling air flow for cooling the emitter and fuel system module. The conversion module 14 further includes a housing 78 which contains the photovoltaic conversion module 14.

The photovoltaic conversion module 14 is threadedly attachable to and removable from the emitter and fuel system module first end 50 and the fuel cartridge module free end 62.

The flashlight lens module 16 includes a lens housing 80 retaining lenses 82. A plurality of lenses 82 is preferred, such that the outer-most lens 82*a* remains cool enough to touch. Like module 14, the lens module 16 is threadedly attachable to and removable from the emitter and fuel system module first end 50 and the fuel cartridge module free end 62. Whichever of the modules 14 and 16 is attached to the fuel cartridge module free end 62 serves as an inactive end cap, while the other is an active module for providing either electrical power (FIG. 2) or light (FIG. 4).

In a flashlight mode (FIG.4), the lens module 16 is attached to the first end 50 of the emitter and fuel system module 10, and the photovoltaic conversion module 14 is attached to the free end 62 of the fuel cartridge module 12. When the on/off valve 40 is switched "on", vaporized fuel is released from the fuel cartridge 36 as the pressure thereof falls, the vaporized fuel passing through the pressure regulator 32 and venturi tube 30 and drawing air into the venturi tube 30 to mix with the fuel therein. The igniter 38 causes ignition of the gaseous mixture which produces a flame at the fuel supply conduit outlet port 22 and within the emitter 18. The heating of the emitter causes illumination thereof. Light radiated by the emitter passes through, and is focused by, the lenses 82. When light is no longer desired, the on/off valve 40 is turned "off" to stop the flow of fuel and the illumination of the emitter 18.

To change the assembly from the flashlight mode (FIG. 4) to the power generation mode (FIG. 2), the lens module 16 and the photovoltaic conversion module 14 are interchanged, such that the latter is adjacent the emitter 18. In this mode, light radiated by the emitter is converted to electric current. The module 14 is provided with an electrical connection (not shown) for communication with an electrical energy consuming device.

Figure 6:
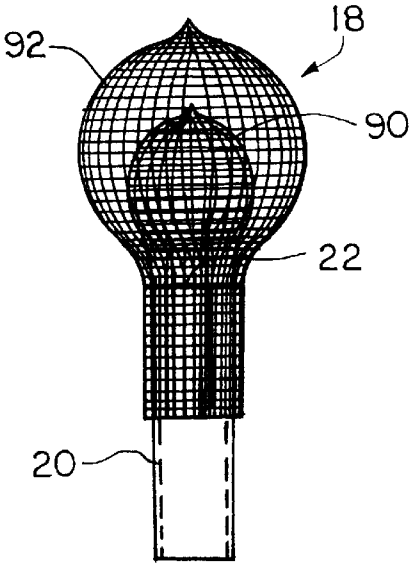
FIG. 6 is a side elevational view of an emitter portion of the assemblies of FIGS. 2 and 4.

Referring to FIG. 6, it will be seen that the emitter 18 preferably is of a bi-layer construction, having bulb-shaped inner and outer ceramic fibrous mantles 90, 92. The fiber density is selected to optimize light output for each mantle, while allowing sufficient airflow therethrough to support combustion. The inner mantle 90 is illuminated during flashlight operation (FIG. 4) and both mantles 90, 92 are illuminated during operation in the power mode (FIG. 2). A higher fuel flow rate is required in the power mode. The fuel flow rate in the power generation mode can be over twenty times the fuel flow rate in the flashlight mode. At the low fuel firing rate in flashlight mode, only the inner mantle 90 of the emitter 18 is illuminated. Exhaust gas exiting the inner mantle 90 is not sufficiently hot to illuminate the outer mantle 92. Light from the inner mantle 90 passes through the outer mantle 92. At the much higher firing rate of the power mode, both inner and outer mantles 90, 92 of the emitter 18 are illuminated.

Figure 7:
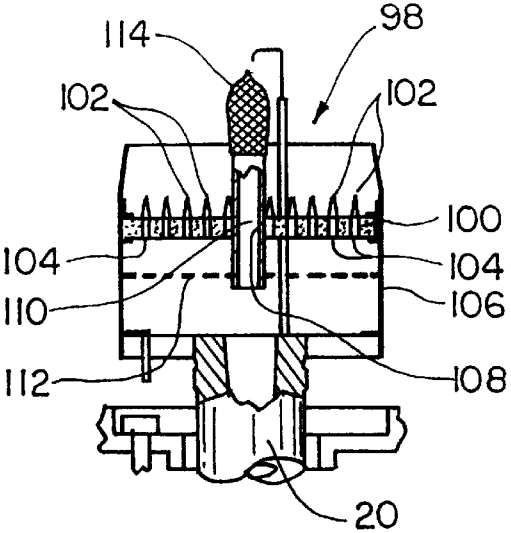
FIG. 7 is a side elevational, partly broken-away, partly sectional view of an alternative embodiment of the emitter portion of the assembly.

Referring to FIG. 7, it will be seen that an alternative embodiment of emitter 98 includes a base member 100 supporting a multiplicity of fibrous erbia mantle elements 102, which may be in the form of loops, and having a multiplicity of flow-through portals 104 extending therethrough. A housing 106 supports the base member 100 and is adapted for snap-fitting on the fuel supply conduit 20. The base member 100 is provided with a central orifice 108 in which is mounted a secondary fuel supply conduit 110. The housing 106 further supports a fuel flow diverter 112 through which extends the secondary fuel supply conduit 110. The housing 106 is mounted in the emitter and fuel system module 10. A mantle 114 is mounted on a distal end of the secondary fuel supply conduit 110.

Figure 8:
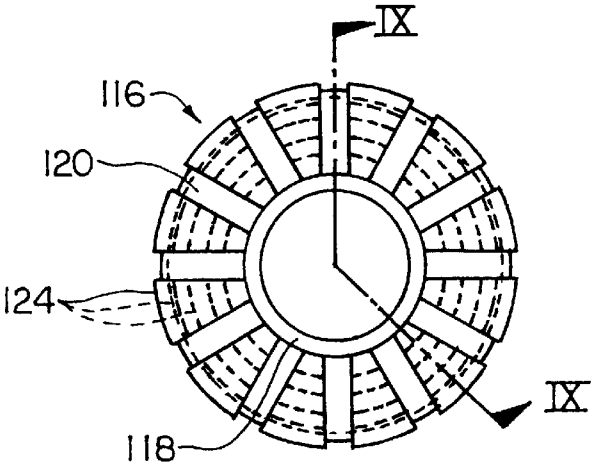
FIG. 8 is a bottom view of an alternative embodiment of a reflector portion of the assembly.
Figure 11:
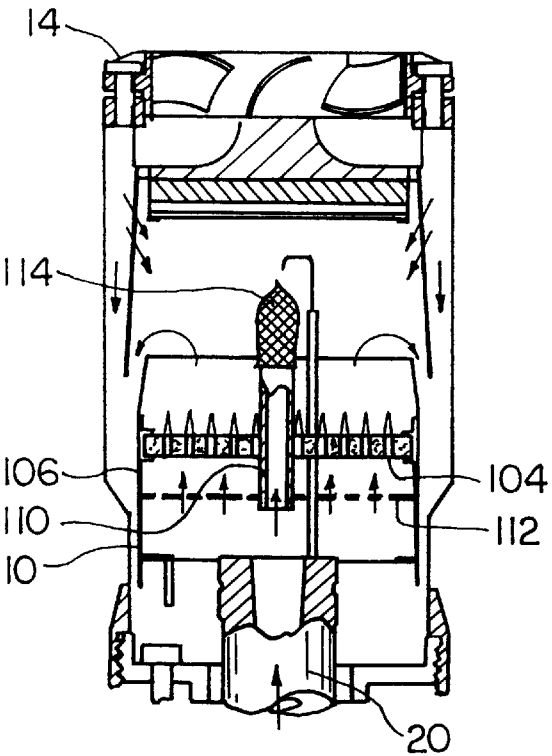
FIG. 11 is a generally sectional view of the emitter of FIG. 7 in combination with a modified emitter and fuel system module.
Figure 9:
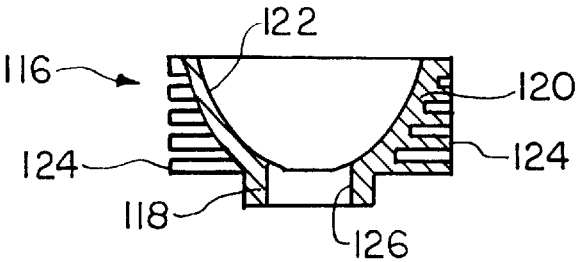
FIG. 9 is a sectional view taken along line IX—IX of FIG. 8.

It has been found that in use of the emitter shown in FIG. 7, the reflector 24 is not needed in the power mode (FIG. 11), and that in use in the flashlight mode (FIG. 10) the temperature of the reflector 24 is excessive. Accordingly, there is provided an alternative embodiment of reflector 116 (FIGS. 8 and 9) having a tubular portion 118 extending from a body portion 120 having an internal generally parabolic reflecting surface 122 and having external radially-extending segmented fins 124. The tubular portion 118 defines a central opening 126 for receiving the secondary fuel supply conduit 110 and the mantle 114.

Figure 10:
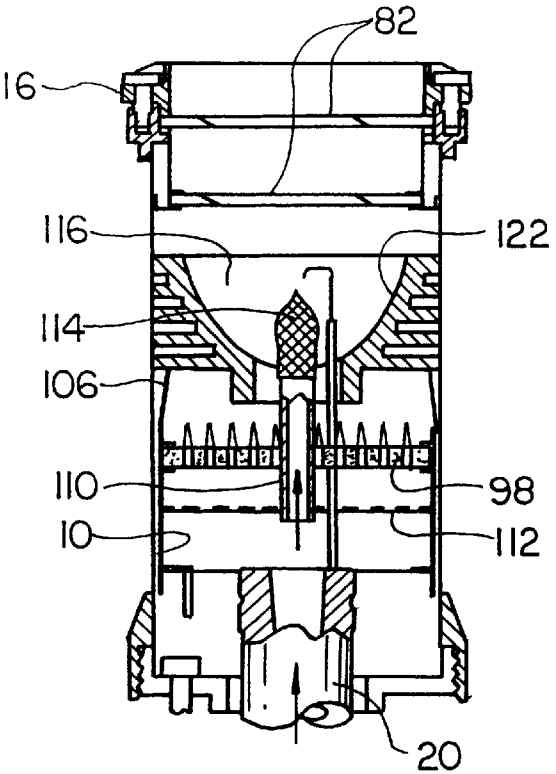
FIG. 10 is a generally sectional view of the emitter of FIG. 7 in combination with the reflectors of FIGS. 8 and 9.

Inasmuch as the reflector 116 is used only with the flashlight lens module 16, the reflector is mounted in the lens module (FIG. 10). In operation, in the flashlight mode, the attachment of the lens module 16 to the emitter and fuel system module 10 positions the emitter 98 in cooperative relation with the reflector 116. In this mode of operation, the fuel flow diverter 112 is closed, causing the flow of fuel/air from the fuel supply conduit 20 to flow through the secondary fuel supply conduit 110 and into the mantle 114. The reflecting surface 122 of the reflector 116 directs light emitted by the mantle 114 onto the lenses 82.

The fins 124 conduct heat away from the reflector body 120. The segmentation of the fins 124 permits flow of cooling air freely around the reflector and around and through the fin segments 128. The emitter 98 receives no fuel in this mode of operation and is inactive.

In converting the assembly from the flashlight mode to the power mode (FIG. 11), the flashlight lens module 16 is detached from the emitter and fuel system module 10 and replaced by the photovoltaic conversion module 14. In this mode of operation, the flow diverter 112 is open, permitting fuel/air flow to proceed through the emitter base member portals 104 and to the mantle elements 102. The flow of fuel/air from the fuel supply conduit 20 also enters and passes through the secondary fuel supply conduit 110 to energize the mantle 114. Thus, in this mode of operation, both mantles 104, 114 are active.

An assembly as shown in FIGS. 2 and 4, having a length of about 30 cm and a diameter of about 5 cm, provided with 44 TPV cells of GaSb, with a cell area of 7.63 $cm^{3,}$ has been found to provide:

(1) 12 volts DC for about 1.6 hours with a fuel cartridge containing 34 g of fuel, and for about 2.25 hours with a fuel cartridge containing 48 g of fuel (either cartridge fits in the assembly); or (2) flashlight output of at least 10 lumens for about 42.5 hours with the smaller fuel cartridge, and about 60 hours with the larger fuel cartridge.

The weight of the assembly described above is about 513 g with the smaller fuel cartridge and about 531 g with the larger fuel cartridge, or a little over one pound, which compares favorably with a comparably sized dry cell flashlight.

There is thus provided a combination flashlight and electrical power source assembly which may readily be converted from one mode of operation to the other, without specialized skills, tools, or extra parts required.

There is further provided an emitter having particular utility in a dual-mode assembly of the type described hereinabove.

It is to be understood that the present invention is by no means limited to the particular construction herein disclosed and/or shown in the drawings, but also comprises any modifications or equivalents within the scope of the claims.

What is claimed is:

1. A combination flashlight and electrical power source assembly, said assembly comprising:

an emitter and fuel system module having first and second ends;

a fuel cartridge module fixed to said emitter and fuel system module at said second end of said emitter and fuel system module, said fuel cartridge module having a free end;

a photovoltaic conversion module attachable to a selected one of said emitter and fuel system module first end and said fuel cartridge module free end; and a flashlight lens module attachable to the other of said emitter and fuel system module first end and said fuel cartridge module free end;

wherein when said photovoltaic conversion module is attached to said emitter and fuel system module first end and said flashlight lens module is attached to said fuel cartridge module free end, said photovoltaic conversion module is an active module and said flashlight lens module is inactive and functions as an end cap and said assembly comprises said electrical power source; and wherein when said flashlight lens module is attached to said emitter and fuel system module first end and said photovoltaic conversion module is attached to said fuel cartridge module free end, said flashlight lens module is an active module and said photovoltaic conversion module is inactive and functions and an end cap, and said assembly comprises said flashlight.

2. The assembly in accordance with claim 1 wherein said emitter and fuel system module comprises a housing in which components thereof are disposed and which provides an outer surface for gripping and handling the assembly.

3. The assembly in accordance with claim 2 wherein said components of said emitter and fuel system module include an on/off valve for admitting and stopping fuel flow from said fuel cartridge module and for selecting fuel pressure for operation of said assembly as a flashlight and as a power source, an igniter for providing ignition of the fuel, a venturi through which the fuel flow passes to induce flow of combustion air and provide mixing of fuel and air prior to combustion, and a pressure regulator for maintaining pressure of fuel in said venturi substantially constant.

4. The assembly in accordance with claim 2 wherein said emitter and fuel system module components include an emitter having first and second ceramic fibrous mantles, said first mantle being adapted for illumination during operation of said assembly as a flashlight, and said first and second mantles being adapted for illumination during operation of said assembly as a power source.

5. The assembly in accordance with claim 2 wherein said emitter and fuel system module components include an emitter having inner and outer bulb-shaped ceramic fibrous mantles, said inner mantle being adapted for illumination during operation of said assembly as a flashlight, and said inner and outer mantles being adapted for illumination during operation of said assembly as a power source.

6. The assembly in accordance with claim 2 wherein said emitter and fuel system module components include an emitter, and a holder for releasably holding said emitter.

7. The assembly in accordance with claim 6 wherein said emitter and fuel system module components include a reflector for focusing radiant energy from the emitter to the selected one of the photovoltaic conversion module and the flashlight lens module.

8. The assembly in accordance with claim 7 wherein said emitter and fuel system module components include a cover glass fixed to said reflector for enclosing and protecting said emitter.

9. The assembly in accordance with claim 1 wherein said fuel cartridge module comprises a fuel cartridge cover for retaining a fuel cartridge.

10. The assembly in accordance with claim 9 wherein said assembly further comprises said fuel cartridge housed in part in said emitter and fuel system module housing and in part in said fuel cartridge module housing.

11. The assembly in accordance with claim 10 wherein said fuel cartridge module is detachable from said emitter and fuel system module and said fuel cartridge comprises a selected one of two fuel cartridges of different sizes for disposition in said emitter and fuel system module and said fuel cartridge module.

12. The assembly in accordance with claim 10 wherein said fuel cartridge contains a selected one of liquid propane and liquid butane.

13. The assembly in accordance with claim 1 wherein said photovoltaic conversion module comprises a housing in which components thereof are disposed.

14. The assembly in accordance with claim 13 wherein said photovoltaic conversion module components include an array of photovoltaic cells for converting radiant energy from said emitter and fuel system module to electrical power.

15. The assembly in accordance with claim 14 wherein said array of photovoltaic cells comprise cells connected in series to provide about 12 volts DC power.

16. The assembly in accordance with claim 15 wherein said cells are a selected one of Gallium antimonide (GaSb) cells, Indium Gallium Arsenide (InGaAs) cells, and silicon (Si) cells.

17. The assembly in accordance with claim 16 wherein said array comprises forty-four Gallium Antimonide cells to provide 12 volts DC power.

18. The assembly in accordance with claim 14 wherein said photovoltaic conversion module components include a selected one of (1) a heat sink for dissipating heat from said array of cells, and a fan for providing cooling air to said heat sink and to said emitter and fuel system module when said photovoltaic conversion module is connected to said emitter and fuel system module, and (2) a natural-convection cooled heat sink.

19. The assembly in accordance with claim 14 wherein said components further include a cover glass for covering and protecting said array of cells.

20. The assembly in accordance with claim 1 wherein said flashlight lens module comprises a housing for supporting a plurality of flashlight lenses.

21. The assembly in accordance with claim 1 wherein said photovoltaic conversion module and said flashlight lens module are each threadedly connectable to said emitter and fuel system module first end, and are each threadedly connectable to said fuel cartridge module free end.

22. The assembly in accordance with claim 20 wherein said flashlight lens module further comprises a reflector for focusing radiant energy from the emitter to said lenses.

23. The assembly in accordance with claim 22 wherein said reflector is provided with segmented fins for conducting heat from said reflector.

24. An emitter for illumination by combustion of a gas therein and for radiating light, said emitter comprising:

an inner mantle comprising a net of ceramic fibers, said inner mantle having a bulbous portion and a further portion adapted for attachment to a discharge end of a fuel supply conduit; and an outer mantle comprising a net of ceramic fibers, said outer mantle having a bulbous portion disposed around and spaced from the bulbous portion of the inner mantle and having a further portion overlying said inner mantle along said further portion of said inner mantle, wherein said inner mantle is adapted to illuminate and radiate light when subjected to combustion at a selected first rate, with the light radiated by said inner mantle passing through said outer mantle, said outer mantle being non-illuminated and non-light-radiating at the first combustion rate, and said inner and outer mantles are both adapted to illuminate and radiate light when subjected to combustion at a selected second rate of combustion substantially higher than said first rate of combustion.

25. The emitter in accordance with claim 24 wherein the fuel supply conduit is tubular and said inner mantle further portion comprises a tubular portion for disposition on the fuel supply conduit, and said outer mantle further portion comprises a tubular portion overlying said inner mantle tubular portion.

26. An emitter for illumination by combustion of a gas therein and for radiating light, said emitter comprising:

a first mantle comprising a generally planar base member defining a multiplicity of portals therethrough and a central opening therethrough, and a multiplicity of mantle elements fixed to a first surface of said base member;

a fuel conduit mounted in said central opening and extending therethrough;

a second mantle of generally bulbous configuration mounted on a first end of said fuel conduit proximate said base member first surface; and a flow diverter proximate a second surface of said base member, a second end of said fuel conduit extending through said flow diverter, said flow diverter being operable to prevent flow of fuel to said portals, such that fuel admitted to said emitter is flowable only through said fuel conduit to said second mantle, and operable to allow flow of fuel to said portals, such that fuel admitted to said emitter is flowable through said fuel conduit to said second mantle and is flowable through said portals to said first mantle elements.

27. The emitter in accordance with claim 26 wherein said first mantle elements comprise loops of material selected from a group of materials consisting of fibrous erbia, ytterbia, and mixed oxide.

28. The emitter in accordance with claim 27 wherein said first mantle elements are adjacent said portals.

29. A reflector for focusing light emitted from a mantle onto a lens, the reflector comprising:

a body portion defining a generally parabolic interior surface for reflecting and focusing the emitted light;

a tubular portion extending outwardly from said body portion and defining an opening permitting the mantle and a portion of a fuel conduit fixed to the mantle to pass therethrough; and fins extending outwardly from said body portion for conducting heat from said body portion.

30. The reflector in accordance with claim 29 wherein said fins extend radially outwardly from said body portion, and are disposed circumferentially on said body portion.

31. The reflector in accordance with claim 30 wherein said fins are interrupted so as to form segments of fins, each segment including a plurality of fins separated by a gap from a neighboring segment of fins.

32. The reflector in accordance with claim 29 wherein the reflector is a unitary one-piece reflector and said body portion, tubular portion, and fins are integral portions thereof.

* * * * *